United States Patent [19]

Sohval

[11] Patent Number: 4,689,809

[45] Date of Patent: Aug. 25, 1987

[54] X-RAY TUBE HAVING AN ADJUSTABLE FOCAL SPOT

[75] Inventor: A. Robert Sohval, Cambridge, Mass.

[73] Assignee: Elscint, Inc., Boston, Mass.

[21] Appl. No.: 819,972

[22] Filed: Jan. 16, 1986

Related U.S. Application Data

[63] Continuation of Ser. No. 443,963, Nov. 23, 1982.

[51] Int. Cl.[4] ..... H01J 35/06

[52] U.S. Cl. ..... 378/136; 378/138

[58] Field of Search ..... 378/138, 136, 137, 119

[56] References Cited

U.S. PATENT DOCUMENTS

| | | | |
|---|---|---|---|
| 3,250,916 | 5/1966 | Rogers | 250/60 |
| 3,452,232 | 6/1969 | Seki et al. | 313/56 |
| 3,649,861 | 3/1972 | Atlee et al. | 378/115 |
| 3,783,333 | 1/1974 | Atlee | 378/138 |
| 3,916,202 | 10/1975 | Heiting et al. | 378/138 |
| 4,002,917 | 1/1977 | Mayo | 250/445 T |
| 4,010,370 | 3/1977 | Lemay | 250/366 |
| 4,048,496 | 9/1977 | Albert | 378/93 |
| 4,072,875 | 2/1978 | Webley | 313/60 |
| 4,109,151 | 8/1978 | Pleil | 378/99 |
| 4,128,781 | 12/1978 | Flisikowski et al. | 313/60 |
| 4,145,616 | 3/1979 | Tanabe | 378/150 |
| 4,229,657 | 10/1980 | Bensussan et al. | 378/125 |
| 4,315,154 | 2/1982 | Weigl et al. | 250/402 |
| 4,373,144 | 2/1983 | Franke | 378/136 |
| 4,400,823 | 8/1983 | Haendle | 378/115 |

FOREIGN PATENT DOCUMENTS

| | | | |
|---|---|---|---|
| 2538948 | 7/1984 | France | 378/136 |

OTHER PUBLICATIONS

*Dictionary of Electronics*, edited by Graf, Radio Shack, 1978–1979, pp. 314–315.

*Primary Examiner*—Janice A. Howell

*Attorney, Agent, or Firm*—Sandler & Greenblum

[57] ABSTRACT

An X-ray tube with an adjustable focal spot is provided wherein the focal-spot position can be moved along the anode and the focal-spot width can be changed by applying a small voltage to the cathode-bias cup. The cathode includes means integral with the cathode for deflecting the flow of electrons to selectable focal-spot areas on the anode in response to an external drive circuit. The cathode includes a filament for emitting electrons to impinge on the anode, and a cathode cup having first and second parts electrically insulated from each other. The filament is electrically insulated from at least one of the parts of the cathode cup. The electrical insulation between the first and second parts of the cathode cup can be provided by a gap therebetween. The device includes biasing means for applying a voltage between the filament and the cathode to control the size and position of the region of impingement of the electron beam on the anode. The anode can be rotatable with respect to the cathode.

19 Claims, 3 Drawing Figures

X-RAY TUBE HAVING AN ADJUSTABLE FOCAL SPOT

This application is a continuation of application Ser. No. 443,963, filed Nov. 23, 1982.

TECHNICAL FIELD OF THE INVENTION

The present invention relates to an X-ray tube having a focal spot adjustable in position and size.

BACKGROUND OF THE INVENTION

Conventional X-ray tubes include a source of a beam of electrons which, under the influence of a high voltage, are caused to impinge on an anode structure. The anode emits X-rays in response to the incident electrons.

It is known to provide multiple focal spots in X-ray tubes in order to generate X-ray beams along a plurality of paths.

One type of multiple-focal spot X-ray tube employs a plurality of independently-controllable heating cathodes. An example of such a system is German Pat. No. 406,067, in which the cathode heating filaments may be supplied by separate heating-current sources, or may be serially connected and selectively supplied with heating current from a common source via a switch. Another example is U.S. Pat. No. 3,452,232, which shows the use of a multiplicity of cathodes, each having a filament element for achieving multiple focal spots.

Another common type of multiple-focal spot system uses a plurality of filament elements with either a single cathode structure or a plurality of cathode structures. Examples of such systems are shown in U.S. Pat. No. 4,315,154, U.S. Pat. No. 4,109,151, and U.S. Pat. No. 3,649,861.

Yet another technique for providing a movable focal spot is shown in United States Pat. No. 4,128,781, which shows an X-ray tube in which the movement of the focus in space is accomplished, without having to move the X-ray tube itself, by moving the cathode along an arcuate path with respect to the anode. A similar system is shown in U.S. Pat. No. 4,072,875, which provides for altering the point of incidence of the electron beam on the anode by moving the anode with respect to the other parts of the tube.

Additionally, a single electron beam could be deflected to selected focal areas to yield a multiple-focal spot system. An example of this is U.S. Pat. No. 4,048,496, which shows an X-ray tube having an electron beam which may be directed to selectable ones of an array of targets to yield X-rays having selected wavelength spectra; the beam in this patent is directed through the use of deflection plates 26. Another example is U.S. Pat. No. 4,229,657, in which an electron beam is deflected to yield a movable impact zone on the target anode. The deflection device uses a magnetic system which employs a rotating magnetic field to cause the emission of photons in several directions, either successively or simultaneously. Finally, U.S. Pat. No. 3,250,916 shows a system in which a single cathode structure produces a single beam of electrons from a single filament, and in which a pair of deflection plates are positioned on opposite sides of the cathode, and are connected by conductive supports to external leads for supplying variable electric potentials to the deflection plates. The potentials on the deflection plates are varied such that a continuous or intermittent beam of electrons from the filament may be alternately switched between two focal spots spaced apart on the target of the anode.

The above-described systems are disadvantageous in that they require a plurality of cathodes, a plurality of filaments, or the use of deflection plates for deflecting the electron beam, thus requiring a relatively large number of structural components.

Moreover, in the systems which use deflection plates, e.g., U.S. Pat. No. 4,048,496 and U.S. Pat. No. 3,250,916, because the deflection plates are located a relatively large distance from the cathode, the electron beam will have achieved appreciable energy by the time the electrons enter the deflection region, and thus, a considerable voltage will be required to achieve deflection of the beam. Also, the necessity of placing the deflection plates between the cathode and anode requires a relatively wide spacing between the cathode and anode, which creates size difficulties in certain applications. Further, the large cathode-to-anode spacing results in a larger-than-normal focal spot size, and this, in turn, requires a complex and costly electron-beam optical system to compensate for this oversized focal spot. In some high-powered applications using rotating anode targets, grid control may become necessary in order to avoid overheating the anode. The above-described systems using separate deflection electrodes have an additional disadvantage in that grid control would require a total of five wires—two for the filament, one for the cathode cup, and two for the deflection electrodes—whereas conventional X-ray tubes and high-voltage components utilize only four wires; thus, a five-wire system would impose additional complexity and expense with respect to the high-voltage cable and connector which deliver power from the high-voltage power supply to the X-ray tube. Also, in U.S. Pat. No. 3,250,916, for example, the invention relates to stereoscopic radiography in which the separation between focal spots corresponds to the distance between the eyes, i.e., the interpupillary distance; although the large cathode-to-anode distance is suitable for such an application, this large distance is unsuitable for other applications where the distance between focal spots must be very small, for example, on the order of 1–2 mm.

SUMMARY OF THE INVENTION

Accordingly, it is an object of the present invention to eliminate the above-described disadvantages associated with conventional multiple-focal spot X-ray systems.

Thus, it is an object of the present invention to provide a multi-focal spot X-ray apparatus having reduced components and simplified structure.

It is another object of the present invention to provide a multi-focal spot X-ray apparatus having a single cathode, a single filament, and deflection means integral with the cathode structure.

It is still another object of the present invention to provide a multi-focal spot X-ray apparatus in which deflection of the electron beam can be achieved in a system having a relatively narrow cathode-to-anode spacing.

It is another object of the present invention to provide a multi-focal spot X-ray apparatus in which deflection of the electron beam can be achieved through the application of a relatively small bias potential.

It is yet another object of the present invention to provide a multi-focal spot X-ray apparatus in which the electron beam is deflected to multiple focal spots, and in which grid control can be achieved through the use of merely four conductive leads.

It is yet another object of the present invention to provide a multi-focal spot X-ray apparatus in which the size of the focal spot may be varied by application of a small bias potential.

Upon further study of the specification and appended claims, further objects, features, and advantages will become more fully apparent to those skilled in the art to which the invention pertains.

Briefly, the above and other objects, features, and advantages of the present invention are attained in one aspect, thereof by providing an X-ray tube having an evacuated chamber in which is disposed an anode for generating X-rays in response to electrons which impinge thereon, and in which is also disposed a cathode which has electron emission means for emitting electrons to impinge on the anode. The electron emission means is preferably a single filament. The cathode cup has first and second parts, electrically insulated from each other, and the electron emission means or filament is electrically insulated from at least one of the parts of the cathode cup. The electrical insulation between the first and second parts of the cathode cup can be provided by a gap between them. The electron emission means or filament can alternatively be electrically insulated from both of the parts of the cathode cup. Biasing means is provided for applying a voltage between the filament and the cathode cup to alter the size and position of the region of impingement of the electron beam on the anode. The biasing means can have first biasing means for applying a voltage between the filament and the first part of the cathode cup, and second biasing means for applying a voltage between the filament and the second part of the cathode cup. In addition, the biasing means can alternatively operate to shut off the current between the filament and the anode. The anode can be either stationary or rotatable with respect to the cathode.

BRIEF DESCRIPTION OF THE DRAWINGS

Embodiments of the present invention are shown by way of example in the accompanying drawings, wherein.

DETAILED DESCRIPTION OF THE INVENTION

Figure 1:
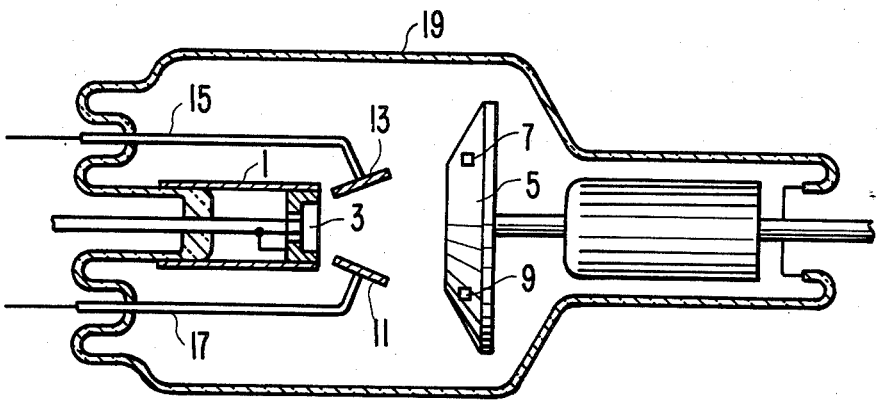
FIG. 1 is an example of a prior art multi-focal spot X-ray tube in which deflection plates are positioned between the cathode and the anode.

Referring now to FIG. 1, a prior art multi-focal spot X-ray tube 19 is shown in which a single cathode structure 1 produces a single beam of electrons from a single filament 3. A pair of deflection plates 11 and 13 are positioned on opposite sides of the cathode 3, and are connected by conductive supports 15 and 17, respectively, to external leads for supplying variable electrical potentials to deflection plates 11 and 13. The potentials on plates 11 and 13 are varied such that a continuous or intermittent beam of electrons from filament 3 may be alternately switched between focal spots 7 and 9, spaced apart on anode 5. It should be noted that if grid control were required in the system shown in FIG. 1, the electrical connection as shown between one side of filament 3 and cathode cup 1 must be interrupted, and a fifth wire must be connected to the cathode cup.

Figure 2:
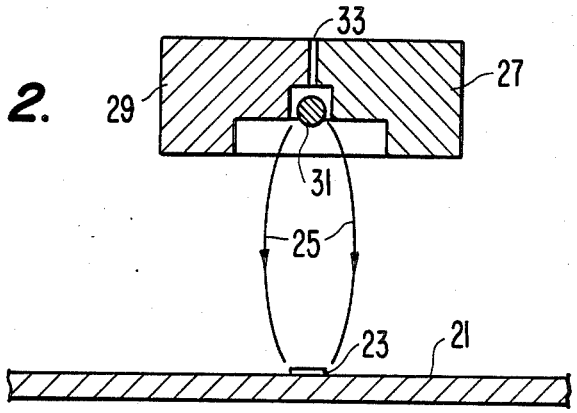
FIG. 2 is a cross-sectional view of the apparatus according to the present invention.

FIG. 2 illustrates the structure of an X-ray tube according to the present invention, wherein the focal spot position can be moved along the anode by applying a small voltage to the cathode-bias cup. FIG. 2 illustrates the preferred embodiment, in which cathode-bias cup 33 has a first part 27 and a second part 29 which are electrically insulated from one another, and from the filament 31. When filament 31 is heated, it emits electrons in a beam 25, which strike anode 21 in a region defining the focal spot 23. Anode 21 is generally made of tungsten or a tungsten alloy, and can be either stationary or rotating.

Filament 31 must be electrically insulated from at least one of the two parts 27, 29 of cathode cup 33. Alternatively, filament 31 can be electrically insulated from both of the cathode-cup parts.

Figure 3:
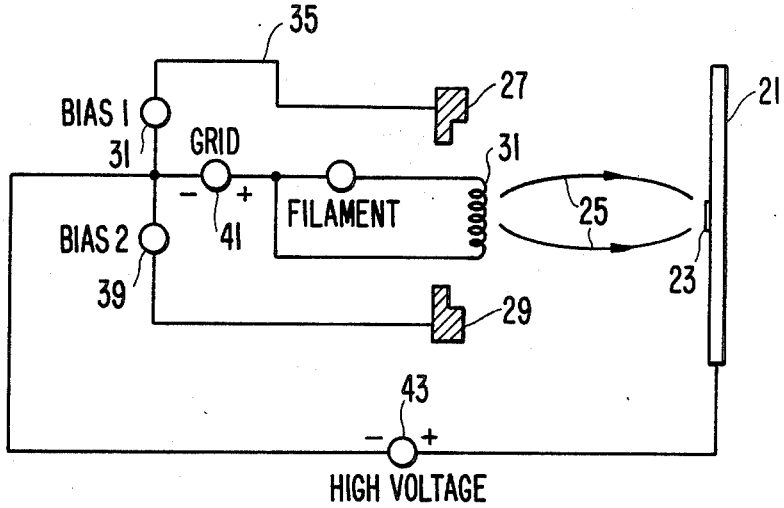
FIG. 3 illustrates a circuit for controlling the apparatus illustrated in FIG. 2.

FIG. 3 illustrates an electrical circuit 35 for controlling the path of electron beam 25 as it is accelerated toward anode 21. The electrical circuit includes a bias supplies 37 and 39 for driving cathode-cup parts 27 and 29, respectively, with respect to filament 31. High-voltage supply 43 drives anode 21 positive with respect to filament 31. Grid drive 41 is pulsed such that it can turn the electron beam 25 on and off by biasing filament 31 positively with respect to cathode-cup parts 27 and 29. A positive bias of about 4 kilovolts will shut off the electron current when the anode voltage is set at 150 kilovolts. Cathode-bias cup electrodes 27 and 29 are biased equal to or negatively with respect to filament 31. For example, if cathode-bias cup 27 is at filament potential, and cathode-bias cup 29 is negative, the focal spot position in the anode will be shifted to the right in FIG. 2, and upward in FIG. 3. If the potentials of cathode-bias cups 27 and 29 are reversed, the deflection direction of the focal spot will also be reversed. Because of the immediate proximity of the cathode cups to the filament a smaller bias is required to deflect the beam as compared to the voltage required to deflect the beam in the deflector plate system shown in FIG. 1.

According to the present invention, the size as well as the position of the focal spot can be controlled by, for example, fixing cathode-bias cup 27, shown in FIG. 2, at a negative voltage, rather than fixing it at filament potential, as described above, and, at the same time, fixing the opposite cathode-bias cup 29 at a larger negative voltage. With the cathode-bias cups set such that they are each biased relative to the filament, the focal spot position can be controlled to shift, as described above, and further, its size will be reduced in the direction parallel to the direction of its shift due to the focusing effect of the two negatively-biased cathode-bias cups 27 and 29.

Bias supplies 37 and 39 can be computer-controlled to permit automatic control of the width of and positioning of focal spot 23 to a multiplicity of locations.

The preferred embodiment is to incorporate the cathode structure according to the invention in the context of a conventional rotating-anode-type X-ray tube, in which case the aximuthal position and the width of the focal spot can be controllably varied. Such an X-ray tube would find useful applications in CT scanners, in which spatial resolution of the CT images would be improved by utilizing an X-ray tube having dual or multiple focal spots.

It should be noted that, if grid action is desirable in a particular application of the X-ray tube of the instant invention, such an arrangement would require the use of only four wires into the tube. This should be contrasted with the prior art system illustrated in FIG. 1, in which a total of five wires are required to achieve grid control, because the electrical connection between one side of filament 3 and cathode cup 1 must be interrupted, and a fifth wire must be connected to the cathode cup; thus, a wire is needed for each of the deflection electrodes, and, in addition, three wires are needed for the filament and cathode cup.

From the foregoing description, one skilled in the art can easily ascertain the essential characteristics of the present invention, and, without departing from the spirit and scope thereof, can make various changes and modifications of the invention to adapt it to various usages and conditions.

What is claimed is:

1. An X-ray tube comprising:

an evacuated chamber having a cathode spaced apart from an anode maintained at a positive voltage relative to the cathode;

said cathode comprising filament means having a longitudinal dimension for emitting electrons in a beam which impinge on said anode at a focal spot having predetermined dimensions and a predetermined location on said anode, and a cathode cup subdivided approximately parallel to said longitudinal dimension into a plurality of parts, insulating means for electrically insulating said plurality of parts from each other, at least part of said insulating means extending along a line substantially parallel to said longitudinal dimension of said filament means; and means for individually and selectively applying potentials to different ones of said plurality of parts of the cathode cup for controlling the dimension and location of said focal spot on said anode in a direction transverse to the longitudinal dimension of the filament means.

2. The X-ray tube according to claim 1 wherein said plurality of parts of said cathode cup comprises a first part and a second part.

3. The X-ray tube according to claim 1 wherein said filament means comprising a single filament.

4. The X-ray tube according to claim 1 wherein said insulating means is a gap provided between said plurality of parts of said cathode cup for electrically insulating said parts from each other.

5. The X-ray tube of claim 33 wherein said filament means is electrically insulated from at least one of said plurality of parts.

6. The X-ray tube according to claim 2 further comprising means for applying a predetermined potential to said filament means.

7. The X-ray tube according to claim 6 wherein said means for individually and selectively applying potentials comprises means for applying a potential to said first part of said cathode cup for shifting the location of said focal spot in a direction along said anode toward said second part, the potential being negative to said filament potential and negative with respect to a potential of said second part.

8. The X-ray tube according to claim 6 wherein said means for individually and selectively applying potentials comprises means for applying a potential to said second part of said cathode cup for shifting the location of said focal spot in a direction along said anode toward said first part, the potential being negative with to respect to a potential of said first part and said filament.

9. The X-ray tube according to claim 6 wherein said means for individually and selectively applying potentials comprises means for applying a potential to said first part of said cathode cup which is negative with respect to said filament potential and for simultaneously applying a potential to said second part of said cathode cup which is negative with respect to the potential applied to said first part for reducing the dimensions of said focal spot and shifting the location of said focal spot in a direction along said anode toward said first part.

10. The X-ray tube according to claim 6 wherein said means for individually and selectively applying potentials comprises means for applying a potential to said second part of said cathode cup which is negative with respect to said filament potential and for simultaneously applying a potential to said first part of said cathode cup which is negative with respect to the potential applied to said second part for reducing the dimensions of said focal spot and shifting the location of said focal spot in a direction along said anode toward said second part.

11. The X-ray tube according to claim 1 wherein said anode is rotatable with respect to said cathode.

12. A method of operating an X-ray tube comprising an evacuated chamber having a cathode spaced apart from an anode adapted to be maintained at a positive voltage relative to the cathode, said cathode comprising electron emission means for emitting the electrons in a beam which impinges on said anode at a focal spot having predetermined dimensions and a predetermined location on said anode, said electron emission means having a longitudinal dimension, a cathode cup having a plurality of parts physically separated from each other by insulating means parallel to the longitudinal dimension of said electron emission means, said method comprising the steps of:

individually and selectively applying potential to said plurality of parts of said cathode cup for controlling the location of the dimensions of focal spot on the anode in a direction transvers to longitudinal dimensions of said electron emission means.

13. The method according to claim 12 further comprising th step of providing a gap between said plurality of parts of said cathode cup for electrically insulating said parts from each other.

14. The method according to claim 13 further comprising the step of subdividing said cathode cup into a first part and a second part.

15. The method according to claim 14 further comprising the step of applying a predetermined potential to said electron emission means.

16. The method according to claim 15 wherein the step of individually and selectively applying potentials comprises the step of applying a potential to said first part of said cathode cup which is negative with respect to a potential of said electron emission means and said second part for shifting the location of said focal spot in a direction along said anode toward said second part.

17. The method according to claim 15 wherein the step of individually and selectively applying potentials comprises the steps of applying a potential to said second part of said cathode cup which is negative with respect to a potential of said first part and said electron emission means for shifting the location of said focal spot in a direction along said anode toward said first part.

18. The method according to claim 15 wherein the step of individually and selectively applying potentials comprises the step of applying a potential to said first part of said cathode cup which is negative with respect to said electron emission means potential and for simultaneously applying a potential to said second part of said cathode cup which is negative with respect to the potential applied to said first part for reducing the dimension of said focal spot and shifting the location of said focal spot in a direction along said anode toward said first part.

19. The method to according to claim 15 wherein the steps of individually and selectively applying potentials comprises the step of applying a potential to said second part of said cathode which is negative with respect to said electron emission means for simultaneously applying a potential to said first part of said cathode cup which is negative with respect to the potential applied to said second part for reducing the dimensions of said focal spot and shifting the location of said focal spot in a direction along said anode toward said second part.

* * * * *